US006475636B1

(12) United States Patent
D'Haene et al.

(10) Patent No.: US 6,475,636 B1
(45) Date of Patent: Nov. 5, 2002

(54) STEEL CORD FOR PROTECTION PLIES OF PNEUMATIC TIRES

(75) Inventors: Urbain D'Haene, Ingooigem; Marc Eggermont, Aalter; Yvan Lippens, Vichte; Dirk Meersschaut, Wielsbeke, all of (BE)

(73) Assignee: N.V. Bekaert S.A., Zwevegem (BE)

( * ) Notice: Subject to any disclaimer, the term of this patent is extended or adjusted under 35 U.S.C. 154(b) by 0 days.

(21) Appl. No.: 09/463,690

(22) PCT Filed: Jun. 30, 1998

(86) PCT No.: PCT/EP98/04184

§ 371 (c)(1),
(2), (4) Date: Mar. 28, 2000

(87) PCT Pub. No.: WO99/06628

PCT Pub. Date: Feb. 11, 1999

(30) Foreign Application Priority Data

Jul. 29, 1997 (EP) ..... 97202329

(51) Int. Cl.[7] ..... B60C 9/00; D07B 1/06

(52) U.S. Cl. ..... 428/592; 428/465; 428/605; 428/625; 152/451; 57/902

(58) Field of Search ..... 428/364, 375, 428/378, 379, 390, 605, 608, 592, 465, 625, 676, 606; 57/902; 152/451

(56) References Cited

U.S. PATENT DOCUMENTS 4,023,989 A * 5/1977 Dobo ..... 148/16
4,106,957 A * 8/1978 Tournoy ..... 148/12 B
4,619,714 A * 10/1986 Thomas et al. ..... 146/12 B
4,854,032 A * 8/1989 Dambre ..... 29/527.4
5,321,941 A * 6/1994 Bollen et al. ..... 57/213
5,592,806 A * 1/1997 Berghmans et al. ..... 57/212
5,709,073 A * 1/1998 Onuma et al. ..... 57/212
5,843,583 A * 12/1998 D'Haene et al. ..... 428/592
5,956,935 A * 9/1999 Katayama et al. ..... 57/902
6,228,188 B1 * 5/2001 Meersschaut et al. ..... 148/595

FOREIGN PATENT DOCUMENTS

| | | | |
|---|---|---|---|
| EP | 0 157 045 | | 10/1985 |
| EP | 0 342 644 | A2 | 11/1989 |
| EP | 0 363 893 | A2 | 4/1990 |
| EP | 0 790 349 | A1 | 8/1997 |
| GB | 1 427 999 | | 3/1976 |
| GB | 2028393 | * | 3/1980 |
| LU | 65 981 | A | 1/1973 |
| WO | 98/18259 | | 4/1998 |

OTHER PUBLICATIONS

L. Bourgois, "Survey of Mechanical Properties of Steel Cord and Related Test Methods." Special Technical Publication 694, ASTM (American Society for Testing and Materials) 1980 (No month).

* cited by examiner

*Primary Examiner*—John J. Zimmerman
*Assistant Examiner*—Andrew T. Piziali
(74) *Attorney, Agent, or Firm*—Foley & Lardner

(57) ABSTRACT

A steel cord particularly adapted for reinforcement of a protection ply in a tire has under compression in rubber a deformation $W_k$ at instability of at least 3% and is stress-relieved so that its total elongation at rupture in rubber exceeds 3.5%. The steel cord comprises pearlite filaments.

6 Claims, 1 Drawing Sheet

STEEL CORD FOR PROTECTION PLIES OF PNEUMATIC TIRES

FIELD OF THE INVENTION

The present invention relates to a steel cord adapted for reinforcement of a protection ply in a tire. Conveniently only one protection ply is provided per tire, but tires with more than one protection ply are not excluded.

BACKGROUND OF THE INVENTION

The protection ply in a tire is the outermost ply in a tire and is the ply which lies closest to the tread and thus to the surface. As a direct result of its position in a tire and as its name says, a protection ply fulfills; a front line function in the protection of a tire: every unevenness and every roughness on the roads are first felt and taken up by the protection ply. Consequently particular requirements are put on cords reinforcing these protection plies.

First of all, the cords must have a high corrosion resistance, since moisture that is able to penetrate via cracks in the tread is most likely to arrive first at the protection ply. Full rubber penetration is a way to slow down the corrosion attack on steel cords. Secondly, the cords must have a high elongation in rubber before they break.

Thirdly, since the cords are not only subjected to elongation but also to compression, they must have a good compression behavior, which means that their deformation at the buckling point or at the point of instability must be relatively high, e.g. above 3%, or preferably above 4%.

As a fourth requirement, the cords must be low-cost.

The prior art has already provided a number of steel cords specially adapted for the reinforcement of protection plies, but no such cord fulfilled the above four requirements to a sufficient degree.

A first type of known steel cords for the reinforcement of protection plies are the so-called high-elongation (HE) cords, such as a 3×7×0.22 or a 4×4×0.22. These are cords comprising a number of strands which are arranged in a Lang's lay configuration, which means that the direction of twist is the same in the strands as in the cord (SS or ZZ). The strands are loosely associated and movable relative to each other in order to give the final cord a high elongation at fracture (e.g. above 5%). This elongation is an elongation measured on the cord as such, not embedded in rubber. Due to the fact, however, that this elongation is mainly of a structural nature, a main part of this elongation gets lost once the cord is embedded in rubber: a sharp drop from above 6% to below 3% is not an exception. These cords have also other drawbacks: they do not allow rubber to penetrate inside the cord and they are not low-cost due to their relatively thin filaments and to their multi-strand character which necessitates two separate twisting steps.

A second type of known steel cords for the reinforcement of protection plies are the so-called elongation (E) cords. An example of an elongation cord is a 4×2×0.35 cord. Just as a high-elongation cord, an elongation cord is also a cord with multiple strands arranged in a Lang's lay configuration (SS or ZZ). The elongation at fracture of the cord as such, i.e. not embedded in rubber, ranges from 4% to 6%. Here again, however, the elongation at fracture falls down to about 2% to 3% once embedded in rubber. An elongation cord also still necessitates two separate twisting steps.

SUMMARY OF THE INVENTION

It is an object of the present invention to provide a steel cord which is suitable for the reinforcement of a protection ply of a tire, i.e. a steel cord with a full rubber penetration, a good compression behavior, a high elongation in rubber and which is low cost.

According to the invention there is provided a steel cord adapted for reinforcement of a protection ply in a tire. The steel cord has under compression in rubber a deformation $w_k$ at instability of at least 3%, preferably at least 4%. The steel cord comprises steel filaments of a pearlitic structure. The steel cord is stress-relieved so that its total elongation at rupture in rubber exceeds 3.5%, preferably at least 4% and most preferably at least 5%.

Preferably the steel cord has such a cord structure that when it is subjected to an increasing tensile load only linear contacts are produced between the individual steel filaments. The reason is that with such steel cords the above-mentioned stress-relieving increases the total elongation at rupture in rubber relatively easily above 3.5% and even above 4%, whereas for other steel cords where tensile loads create point contacts between the individual steel filaments, it is more difficult or in some cases even impossible to reach the 4% level.

For reason of obtaining a determined level of breaking load, the diameter of the individual filaments preferably exceeds 0.30 mm, most preferably 0.35 mm, e.g. 0.38 mm or 0.40 mm. A supplemental advantage is that the cutting resistance, an important property for steel cords lying in a protection ply, is increased with thicker filaments.

BRIEF DESCRIPTION OF THE DRAWINGS

The invention will now be described into more detail with reference to the accompanying drawings wherein.

DESCRIPTION OF THE PREFERRED EMBODIMENTS OF THE INVENTION

As a matter of example, a way of manufacturing a 5×0.38 open cord will now be explained.

Steel filaments with a pearlitic structure and with a composition having a carbon content of 0.80%, a manganese content of 0.50%, a silicon content of 0.25%, a maximum sulphur content of 0.03%, a maximum phosphorous content of 0.03%, the remainder being iron and unavoidable traces of copper, chromium nickel and/or aluminium and plated with a thin coating of brass are wet drawn until a final diameter 0.38 mm and a tensile strength $R_m$ of about 2700 MPa and are wound on spools.

Five drawn filaments are unwound from spools and are preformed, which means that they are plastically deformed, more particularly bent to a radius of curvature which is less than that is necessary to keep the filaments once twisted in a closed compact configuration, i.e. in reciprocal line contact. The preformed filaments are further twisted by means of a common double-twisting device. In a preferred embodiment, the steel cord has a twisting pitch above 10 mm.

Figure 1:
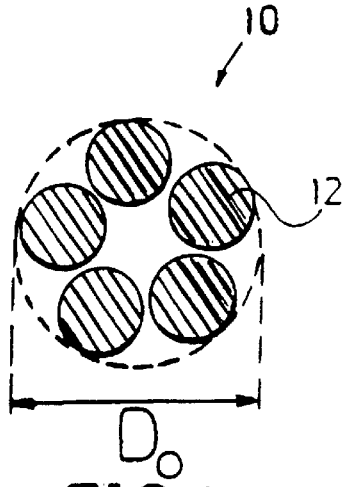
FIG. 1 shows a transversal cross-section of an open steel cord according to the invention.
Figure 2:
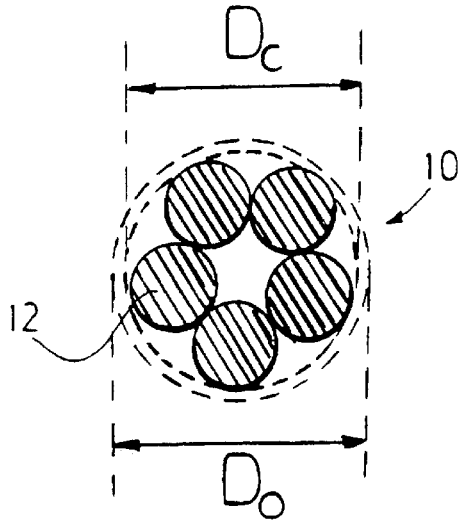
FIG. 2 shows a transversal cross-section of a corresponding closed steel cord.

The result is a 5×0.38 open cord, a transversal cross-section of which has been shown in FIG. 1. The steel cord 10 comprises five steel filaments 12 with a diameter of 0.38 mm. A transversal cross-section of a corresponding closed compact cord is shown in FIG. 2. $D_o$ is the optical diameter of the open cord. $D_c$ is the diameter of the corresponding closed configuration. $D_o$ must be substantially greater than $D_c$. Conveniently following relationship exists $$1.02 \times D_c \leq D_o \leq 1.15 \times D_c$$

In case the transversal cross-section of the 5×0.38 cord is oval or elliptical, the optical diameter $D_o$ is equal to the average of the diameter measured along the long axis and of the diameter measured along the short axis.

The thus formed cord 5×0.38 open cord is subjected to a stress-relieving treatment. The cord is passed through a high-frequency or mid-frequency induction coil of a length that is adapted to the speed of the cord. It is hereby observed that a heat treatment at a specified temperature of about 300° C. and for a certain period of time brings about a reduction of tensile strength of about 10% without any increase in plastic elongation at break. By slightly increasing the temperature, however, to more than 400° C., a further decrease of the tensile strength is observed and at the same time an increase in the plastic elongation at break. In this way the plastic elongation alone, i.e. without adding the amount of structural elongation and the amount of elastic elongation, can—dependent upon the particular type of cord construction—be increased to more than 6%, while the tensile strength decreases e.g. from 2700 MPa to about 2300 MPa for this cord with a filament diameter of 0.38mm.

It has been observed by the inventors that with micro-alloyed compositions, e.g. steel compositions comprising 0.85 to 1.1% C, 0.10 to 1.2% Mn and up to 0.40% of chromium, cobalt, molybdenum, nickel, and/or vanadium, or with steel compositions with a higher silicon content (Si up to 1.5%), the decrease in tensile strength due to the stress-relieving treatment is limited.

Figure 3:
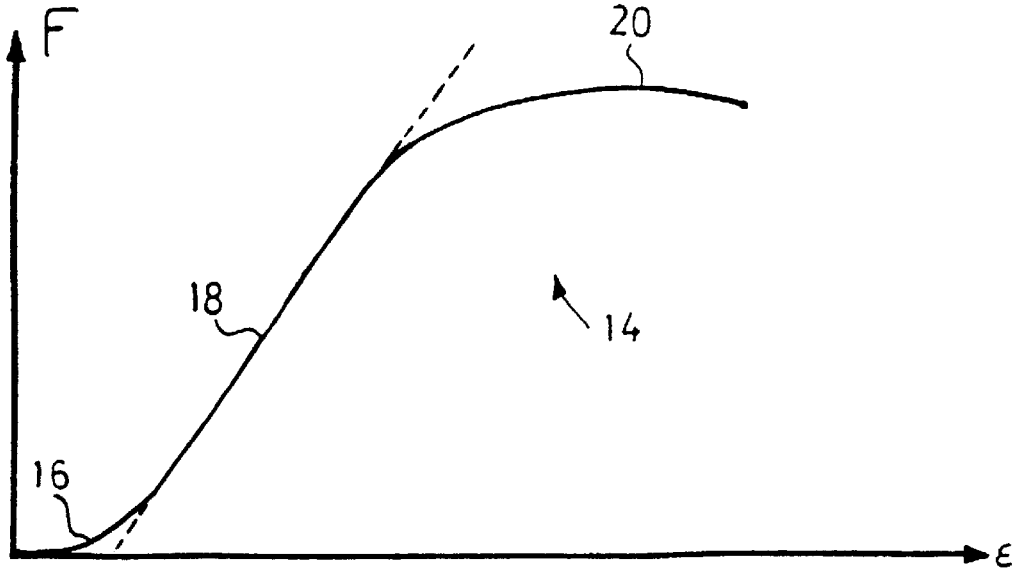
FIG. 3 shows a load-elongation curve of a steel cord according to the invention.

With respect to the different kinds of elongation, a distinction must be made between "structural elongation", "elastic elongations", and "plastic elongation". Reference is hereby made to FIG. 3, where a load-elongation curve 14 of a 5×0.38 open cord according to the present invention is schematically shown.

The structural part of the elongation is designated by reference number 16. The structural elongation is a result of the cord structure or of the preforming given to the steel filaments. It can be characterized by the ratio $D_o/D_c$ or by the PLE or part load elongation, which expresses the elongation at very small loads below 50 Newton. Indeed the structural part 16 of curve 14 is characterized by a very small slope, much smaller than the E-modulus, and by relatively large elongations for small loads. The elastic part of the elongation is designated by reference number 18 and follows Hook's linear law: $\sigma = E \times \epsilon$.

The plastic part of the elongation is designated by reference number 20 and starts where curve 14 leaves the straight line with as slope the E-modulus. The plastic part 20 occurs mainly above 85% to 90% of the breaking load of the steel cord.

Embedding the 5×0.38 open cord in the rubber of a protection ply will cause the tensile strength of the cord to increase from about 2300 MPa to above 2400 MPa.

A 5×0.38 open steel cord according to the present invention has been compared with various other prior art cords with respect to the requirements put on steel cords for the reinforcement of protection plies. Table 1 summarizes these results.

The following comments can be given with respect to the compression test. Due to their high length-to-diameter ratio steel cords as such have no resistance to compression. Once embedded in rubber, however, a steel cord can build up a considerable compression resistance. A cylinder test has been developed, which provides information on the compression properties of rubber-embedded steel cords. A rubber cylinder with a diameter of 30 mm and a height of 48.25 mm is reinforced exactly in the center with a test steel cord. By means of a precision mold and by tensioning the steel cord during curing, the cord is kept straight and exactly in the axis of the cylinder. The compression test records a force versus deformation diagram. $w_k$ is the deformation at instability or at the buckling point. Further details about the compression test may be read from L. BOURGOIS, Survey of Mechanical Properties of Steel Cord and Related Test Methods, Special Technical Publication 694, ASTM, 1980. A steel cord for protection plies is said to have a good compression behavior if $w_k$ exceeds 3%.

TABLE 1

| | 3 × 7 × 0.22 HE | 4 × 2 × 0.35 E | 5 × 0.38 open cord | 5 × 0.38 WO-A-95/18259 | 5 × 0.38 invention |
|---|---|---|---|---|---|
| Lay lengths | 4.5/8 SS | 3.9/10 SS | 12.5 S | 12.5 S | 12.5 S |
| Rubber penetration (%) | 0 | 100 | 100 | 100 | 100 |
| Tensile test as such | | | | | |
| $F_m$ (N) | 1811 | 1512 | 1540 | 1490 | 1317 |
| $R_m$ (MPa) | 2074 | 1854 | 2686 | 2601 | 2301 |
| $A_t$ (%) | 6.0 | 4.4 | 3.8 | 5.5 | 6.8 |
| Tensile test embedded | | | | | |
| $F_m$ (N) | 1939 | 1634 | 1667 | 1564 | 1400 |
| $R_m$ (MPa) | 2220 | 2004 | 2908 | 2729 | 2446 |
| $A_t$ (%) | 2.68 | 2.16 | 2.09 | 4.6 | 5.83 |
| Compression test | | | | | |
| $W_k$ (%) | >5 | >5 | 4.23 | 1.7 | 4.3 |

$F_m$ = breaking load expressed in N (Newton);
$R_m$ = tensile strength expressed in MPa (MegaPascal
$A_t$ = total elongation at fracture expressed in percent;
$W_k$ = deformation at instability (buckling) expressed in percent
WO-A-95/18259 = with helicoidally preformed filaments Following conclusions can be drawn from Table 1.

A 3×7 HE construction, commonly used for the reinforcement for protection plies, scores good for compression behavior and elongation as such, but this elongation falls down to a poor 2.68% once embedded in rubber. Moreover rubber penetration is not existent.

A 4×2 E cord, also commonly used for the reinforcement of protection plies, scores good for rubber penetration, compression behavior and relatively good for elongation as such, but here again, the elongation decreases to 2.16% once embedded in rubber.

A 5×0.38 open cord as such, this is without any further supplementary treatment, scores good with respect to rubber penetration and compression behavior. The inferior points are the elongation both as such and in rubber.

A 5×0.38 open cord helicoidally preformed according to WO-A-95/18259 has also been tested. The helicoidal preformation, however, has here a negative influence on the compression behavior since it decreases the deformation at instability $w_k$ to 1.7%

Only a 5×0.38 open invention cord, i.e. stress-relieved as described hereabove, scores good with respect to rubber penetration, elongation as such and embedded and compression.

The invention cord has also been compared with another type of cord not belonging to the prior art, more particularly with an existing 2+6 cord construction where the stress-relieving treatment has been applied.

Table 2 summarizes the results of this comparison.

TABLE 2

| | 2 + 6 × 0.33 NT not stress-relieved | 2 + 6 × 0.33 HT stress-relieved | 4 × 2 × 0.35 stress-relieved invention | 5 × 0.38 invention |
|---|---|---|---|---|
| Lay lengths | 9/18 SS | 9/18 SS | 3.9/10 SS | 12 S |
| Rubber penetration (%) | 100 | 100 | 100 | 100 |
| Tensile test as such | | | | |
| $F_m$ (N) | 1683 | 1652 | 1553 | 1317 |
| $R_m$ (MPa) | 2461 | 2448 | 1851 | 2301 |
| $A_t$ (%) | 2.81 | 5.64 | 4.5 | 6.8 |
| Tensile test embedded | | | | |
| $F_m$ (N) | 1819 | 1705 | 1662 | 1400 |
| $R_m$ (MPa) | 2659 | 2527 | 1982 | 2446 |
| $A_t$ (%) | 1.69 | 5.51 | 3.76 | 5.83 |
| Compression test | | | | |
| $W_k$ (%) | 0.73 | 0.62 | >5 | 4.3 |

$F_m$ = breaking load expressed in N (Newton);
$R_m$ = tensile strength expressed in MPa (MegaPascal;
$A_t$ = total elongation at fracture expressed in percent;
$W_k$ = deformation at instability (buckling) expressed in percent
HT = high tensile strength = Rm > 2250 − 1130 xlogd before stress-relieving
NT = normal tensile strength = Rm > 2250 − 1130 xlogd A stress-relieved 2+6 cord scores good with respect to rubber penetration, elongation as such and embedded, but the stress-relieving treatment does not improve the rather poor compression behavior.

A stress-relieved 4×2 E cord scores good with respect to rubber penetration, elongation as such and embedded and compression behavior. The elongation as such and embedded, however, is smaller than the corresponding values of a 5×0.38 open invention cord.

According to the inventors, this is due to the point contacts created between the filaments of a 4×2 E cord when this cord is subjected to a tensile load.

A supplemental advantage of a steel cord according to the present invention is as follows. In particular tire designs the protection ply is reinforced by a single steel cord that is wound helically in several windings at an angle ranging from -5° to +5° with respect to the equatorial plane (this in distinction with a normal belt or breaker ply where the steel cords lie in separate limited lengths next to each other and form an angle of about 150 to 300). When vulcanising this protection ply a substantial deformation may occur particular at the edges of the protection ply. This deformation can be easily taken up by a steel cord with the necessary elongation in rubber, just as a steel cord according to the invention.

With steel filaments of a martensitic structure instead of steel filaments of a pearlitic structure, the inventors have experienced that a total elongation at break of at least 5% is difficult to reach, and that, even if a high elongation at break is reached for a non-embedded steel cord, this elongation falls down considerably once the cord has been vulcanized in an elastomer.

What is claimed is:

1. A steel cord adapted for reinforcement of a protection ply in a tire, said steel cord having under compression in rubber a deformation $w_k$ at instability of at least 3%, said steel cord comprising steel pearlite filaments, characterized in that said steel cord is stress-relieved so that its total elongation at rupture in rubber exceeds 3.5%.

2. A steel cord according to claim 1, said steel cord comprising steel filaments and said steel filaments being twisted with a same twisting pitch.

3. A steel cord according to claim 1 wherein said steel cord consists of three to six steel filaments, preformed so that a diameter of the steel cord is substantially greater than a diameter of a corresponding compact cord where all the steel filaments have linear contact with each other along the cord length.

4. A steel cord according to claim 2 wherein the filament diameter is greater than 0.30 mm.

5. A steel cord according to claim 2 wherein the steel cord consists of five filaments.

6. A steel cord according claim 2 wherein the steel cord has a twisting pitch above 10 mm.

* * * * *